US006145204A

United States Patent [19]

Cash

[11] Patent Number: 6,145,204

[45] Date of Patent: Nov. 14, 2000

[54] EATING IMPLEMENT

[76] Inventor: Diane M. Cash, 5204 E. Wallace Ave., Scottsdale, Ariz. 85254

[21] Appl. No.: 09/418,849

[22] Filed: Oct. 15, 1999

[51] Int. Cl.[7] ..... A47J 43/28

[52] U.S. Cl. ..... 30/322; 30/323; 30/324; 30/327

[58] Field of Search ..... 30/322, 324, 323, 30/325, 326, 327, 328, 150, 169, 314, 315, 317, 137, 141, 142, 124; D7/653, 654, 691, 663

[56] References Cited

U.S. PATENT DOCUMENTS

| | | | |
|---|---|---|---|
| 14,275 | 2/1856 | Blodgett . | |
| 17,128 | 4/1857 | Williams | 30/315 |
| D. 58,881 | 9/1921 | Canellas . | |
| D. 93,956 | 10/1934 | Wilson . | |
| D. 148,984 | 3/1948 | Fenety . | |
| D. 164,347 | 8/1951 | Barr, Jr. | D7/653 |
| D. 184,317 | 1/1959 | McArthur . | |
| 202,757 | 4/1878 | Reese . | |
| D. 249,926 | 10/1978 | Wong . | |
| 260,157 | 6/1882 | Brower | 30/298.4 |
| D. 308,804 | 6/1990 | Hiscott et al. | D7/691 |
| 936,695 | 10/1909 | Barth | 30/169 |
| 1,128,190 | 2/1915 | Routery | 30/327 |
| 1,130,281 | 3/1915 | Hay | 30/315 |
| 1,347,307 | 7/1920 | Thomas | 30/322 |
| 1,354,709 | 10/1920 | Williams | 30/169 |
| 2,294,569 | 9/1942 | Petersen | 30/124 |
| 2,473,288 | 6/1949 | McNeill . | |
| 2,724,894 | 11/1955 | Tour | 30/324 |
| 3,451,132 | 6/1969 | Mulkins | 30/317 |
| 3,877,143 | 4/1975 | Montesi | 30/124 |
| 4,182,032 | 1/1980 | Newport . | |
| 4,877,609 | 10/1989 | Beck et al. | 30/124 |
| 4,896,423 | 1/1990 | Kinsey . | |
| 5,182,860 | 2/1993 | Kuhlman | 30/324 |

FOREIGN PATENT DOCUMENTS

| | | | |
|---|---|---|---|
| 4127/31 | 8/1932 | Australia . | |
| 549361 | 11/1922 | France | 30/324 |
| 763755 | 2/1934 | France | 30/322 |
| 230668 | 11/1922 | Switzerland | 30/322 |

*Primary Examiner*—Hwel-Slu Payer
*Attorney, Agent, or Firm*—Parsons & Goltry; Robert A. Parsons; Michael W. Goltry

[57] ABSTRACT

An eating implement comprising an elongate element defining a first length and opposing ends, a handle extending from one of the opposing ends in a first direction and at a right angle relative to the elongate element, the handle defining a second length equal substantially to the first length, and a head for engaging and accommodating food, the head extending from the other one of the opposing ends in a second direction and at a right angle relative to the elongate element, the second direction being opposite to the first direction defined by the handle.

6 Claims, 2 Drawing Sheets

10
11
12
13
14
15
16
18
20
21
22
23
23A
23B
23C
25
26
27
5

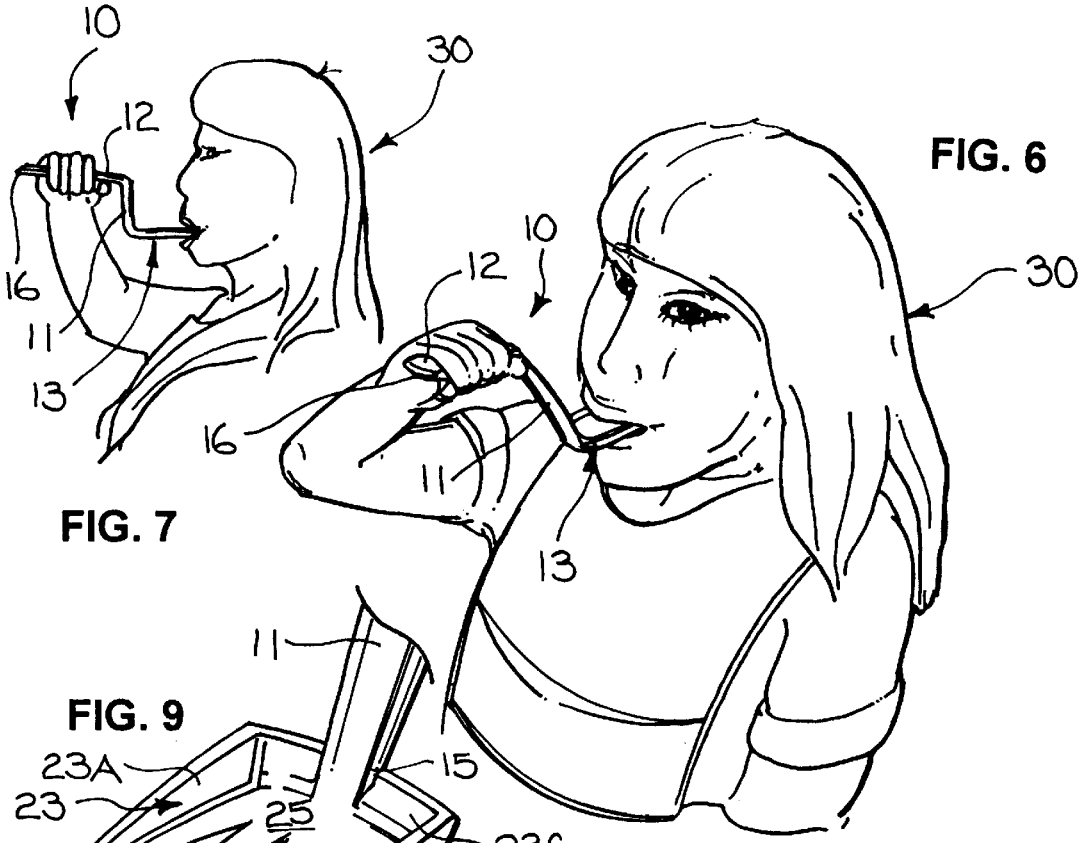
FIG. 6
FIG. 7
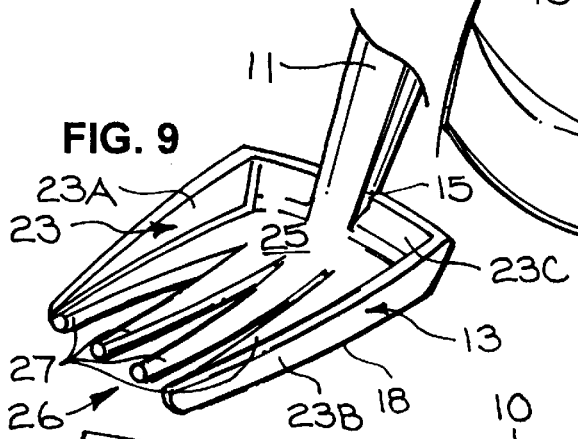
FIG. 9
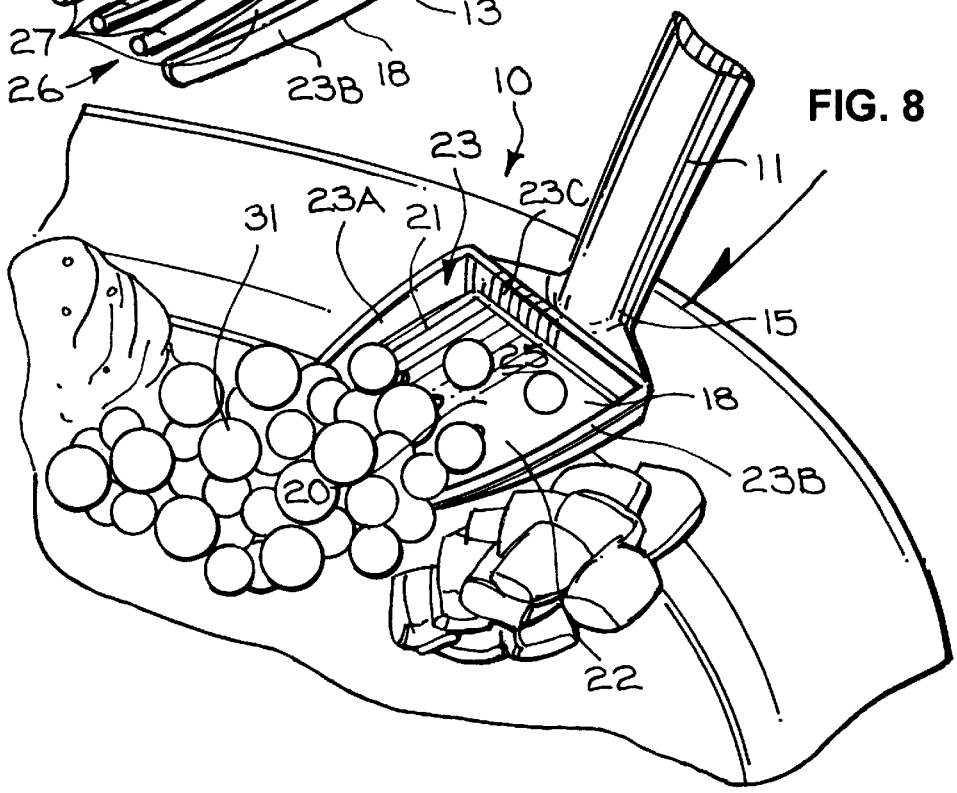
FIG. 8

EATING IMPLEMENT

FIELD OF THE INVENTION

This invention concerns eating implements and, more particularly, to an eating implement for aiding young children in consuming food.

BACKGROUND OF THE INVENTION

One of the biggest challenges that face young children is learning how to eat with utensils such as forks and spoons. For the average child, at least in the United States, this learning process begins between one and two years of age when parents begin placing utensils before the child during meals. By watching and receiving direction from the parents, the child begins to use the utensils. With experience, children eventually become proficient at eating with utensils. Prior to reaching this point, however, using the utensils proves very challenging.

When beginning to use a utensil, such as a spoon or fork, most children grip the handle with a fist or fist-like grip, with the pinkie facing one end of the handle and the thumb facing the spoon or forked end. After scooping up food, the child then attempts to bring the spoon or forked end to her mouth. Because of the conventional structure of the utensil and this fist or fist-like grip, most children twist the utensil just before it reaches the mouth, which causes the food held by the spoon or forked end to fall away, leaving the little if any food on the utensil for the child to consume. To solve these and other problems, and to help children eat more efficiently when learning to use utensils, the need for certain new and useful improvements is evident.

Accordingly, it would be highly desirable to provide a new and improved eating implement.

It is a purpose of the invention to provide a new and improved eating implement that is easy to use.

It is another purpose of the invention to provide a new and improved eating implement that is easy to construct.

It is still another purpose of the invention to provide a new and improved eating implement that is inexpensive.

It is a further provision of the invention to provide a new and improved eating implement that aids a child in eating efficiently when first learning how to eat with conventional utensils such as forks and spoons.

SUMMARY OF THE INVENTION

The above problems and others are at least partially solved and the above purposes and others realized in a new and improved eating implement. The implement is comprised of an elongate element defining opposing ends, a handle extending from one of the opposing ends at a right angle relative to the elongate element, and a head for engaging and accommodating food. The elongate element and the handle are of preferably the same or substantially the same length, and the head extends from the other one of the opposing ends of the elongate element at a right angle relative to the elongate element and in a direction opposing the direction in which the handle extends. In a preferred embodiment, the head defines a trough for containing food and a free end defined by tines that project along parallel axes.

BRIEF DESCRIPTION OF THE DRAWINGS

The foregoing and further and more specific objects and advantages of the invention will become readily apparent to those skilled in the art from the following detailed description thereof taken in conjunction with the drawings in which:

FIG. 6 is a perspective view of the eating implement of FIG. 1 shown as it would appear in use;

FIG. 7 is a side view of the eating implement of FIG. 1 shown as it would appear in use;

FIG. 8 is a fragmented perspective view of the eating implement of FIG. 1 shown as it would appear engaging food; and FIG. 9 illustrates another embodiment of an operative or food engaging end of the eating implement of FIG. 1.

DETAILED DESCRIPTION OF A PREFERRED EMBODIMENT

Figures 1, 2, 3, 4, 5:
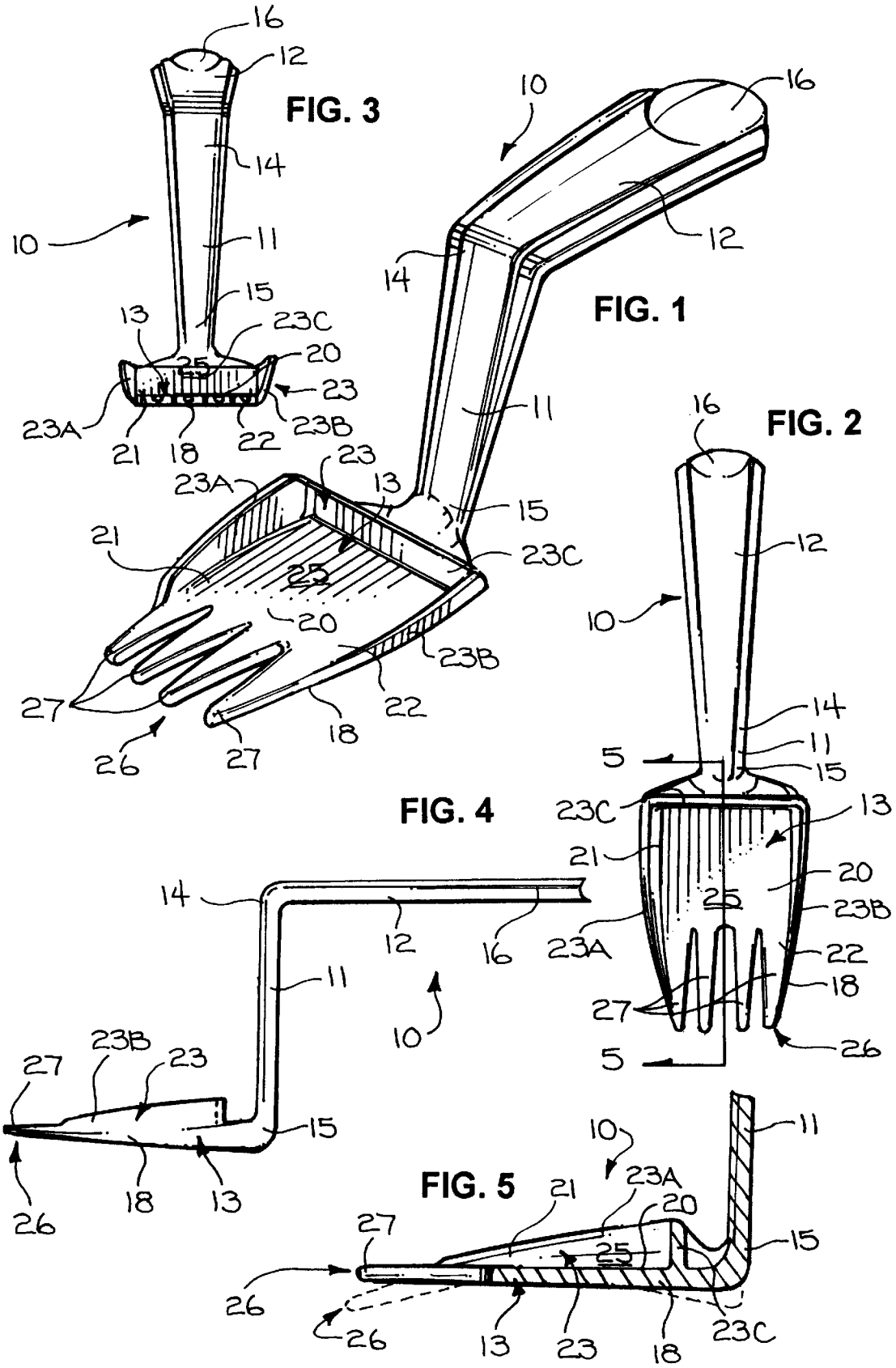
FIG. 1 is a perspective view of an eating implement.
FIG. 2 is a front elevational view of the eating implement of FIG. 1.
FIG. 3 is a top elevational view of the eating implement of FIG. 1.
FIG. 4 is a side elevational view of the eating implement of FIG. 1.
FIG. 5 is a sectional view taken along line 5—5 of FIG. 2.

Turning to the drawings, in which like reference characters indicate corresponding elements throughout the several views, attention is directed to FIGS. 1–4 illustrating various views of an eating implement 10. Implement 10 is constructed of plastic and/or a selected metal or other material, and is comprised of three main parts including an elongate element 11, a handle 12 and a head 13 which defines an operative or food engaging end. Elongate element 11 defines opposing ends 14 and 15 and a length. Elongate element 11 supports handle 12, which extends in a direction away from end 14 at, or substantially at, a right angle to elongate element 11. Handle 12 defines an outer or distal end 16 and a length equal to, or substantially equal to, the length of elongate element 11.

Regarding FIG. 1, head 13 is for engaging and accommodating food, much like the spoon- or forked-end of a conventional spoon or fork. In this embodiment, head 13 extends away from end 15 of elongate element 11 in a direction that is opposite to the direction handle 12 extends. Head 13 is orientated at, or substantially at, a right angle relative to elongate element 11, and is comprised of an essentially broadened body 18 that defines a face 20 for receiving and holding food, lateral extremities 21 and 22 and a sidewall 23. Body 18 further defines a free or outer end 26, and a length that, in a preferred embodiment, is less than the length of elongate element 11 and the length of handle 12. In this embodiment outer end 26 is defined by tines 27 that project along parallel axes. Tines 27 may be formed shallow as shown, or deep as illustrated in FIG. 9. Sidewall 23 is defined by the cooperation of shoulders 23A and 23B extending outwardly from lateral extremities 21 and 22, respectively, and an endwall 23C located adjacent end 15 of elongate element 11. Sidewall 23 cooperates with face 20 to define a trough 25 (FIG. 5) directed toward end 15 of elongate element 11. Body 18 and face 20 may be flat as shown, or somewhat curved (shown in dotted outline) along its length with face 20 being provided as somewhat convex substantially from end 15 of elongate element 11 to outer end 26.

Regarding FIGS. 6 and 7, handle 12 is of a size sufficient so that it may held in a fist-like grip by a young child 30 of an age ranging from perhaps one to six years. In a preferred embodiment, handle 12 is approximately three to six inches in length, with elongate element 11 being of the same or substantially the same length. With handle 12 held in a fist-like grip, as implement 10 is specifically constructed to be held, the pinkie finger of the hand faces toward or resides at or adjacent distal end 16, and the thumb of the hand faces toward or resides at or adjacent the point where handle 12 meets end 14 of elongate element 11. Properly held, head 13 will extend away from the palm of the gripping hand as substantially shown. So held, the child 30 may manipulate head 13 to engage and pick up food 31 as shown in FIG. 8. Tines 27 help to manipulate food much like a fork, and trough 25 helps to collect the food and contain it in a supported condition during transport of the food from a plate or bowl to the child's mouth. Because of the equal or substantially equal lengths of the elongate body 11 and the handle 12, and the previously described orientations of the handle 12 relative to the elongate body 11 and the head 13 relative to the elongate body 11 and the handle 12, young children maintain head 13 at a level attitude when bringing food upon it to and into the mouth while gripping handle with the first or fist-like grip described previously. As a result of achieving this level head 13 attitude during the travel of head 13 to and into the child's mouth, food carried by head 13 will not fall away as a result of a tilting of head 13 to one side or the other.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An implement, comprising:

an elongate element having a first length and opposing ends;

a handle extending from one of the opposing ends in a first direction and at a substantially right angle relative to the elongate element, the handle having a second length equal substantially to the first length; and a head extending away from the other of the opposing ends in a second direction opposite the first direction and at a substantially right angle relative to the elongate element and terminating with an outer end;

the head having a third length extending from the other of the opposing ends of the elongate element to the outer end that is less than the first length and the second length, a face for receiving and holding food that is convex substantially from the other of the opposing ends of the elongate element to the outer end and a sidewall that cooperates with the face to form a trough located adjacent the other of the opposing ends of the elongate element and away from the outer end.

2. The implement of claim 1, wherein the outer end of the head is defined by tines.

3. The implement of claim 2, wherein the tines project along parallel axes.

4. An implement, comprising:

an elongate element having opposing ends;

a handle extending from one of the opposing ends of the elongate element in a first direction and at a substantially right angle relative to the elongate element; and a head extending away from the other of the opposing ends in a second direction opposite the first direction and at a substantially right angle relative to the elongate element and terminating with an outer end;

the head having a face for receiving and holding food that is convex substantially from the other of the opposing ends of the elongate element to the outer end and a sidewall that cooperates with the face to form a trough located adjacent the other of the opposing ends of the elongate element and away from the outer end.

5. The implement of claim 4, wherein the outer end of the head is defined by tines.

6. The implement of claim 5, wherein the tines project along parallel axes.

* * * * *